United States Patent [19]

Nakajima et al.

[11] 4,250,426

[45] Feb. 10, 1981

[54] SPARK PLUG HAVING VANADIUM OXIDE ISLANDS ON CENTRAL INSULATOR

[75] Inventors: Koichi Nakajima, Nagoya; Tomoji Ishiguro, Aichi; Tokuhiko Okamoto; Minoru Konaka, both of Nagoya; Minoru Nagai, Kariya; Kanji Higuchi, Hekinan; Kenji Sasaki, Kariya, all of Japan

[73] Assignee: Kabushiki Kaisha Toyota Chuo Kenkyusho and Nippondenso Co., Ltd., Aichi, Japan

[21] Appl. No.: 950,541

[22] Filed: Oct. 12, 1978

[30] Foreign Application Priority Data

Oct. 14, 1977 [JP] Japan ..... 52/123941

[51] Int. Cl.[3] ..... H01T 13/20

[52] U.S. Cl. ..... 313/143; 313/141

[58] Field of Search ..... 313/130, 137, 143

[56] References Cited

U.S. PATENT DOCUMENTS

| | | | |
|---|---|---|---|
| 2,899,585 | 8/1959 | Dollenberg | 313/143 |
| 3,252,034 | 5/1966 | Preist et al. | 333/252 X |
| 3,365,605 | 1/1968 | Linstedt | 313/143 X |

FOREIGN PATENT DOCUMENTS

| | | | |
|---|---|---|---|
| 50-43629 | 12/1975 | Japan | 313/143 |

*Primary Examiner*—Robert Segal

*Attorney, Agent, or Firm*—Berman, Aisenberg & Platt

[57] ABSTRACT

A spark plug, wherein a central electrode is electrically insulated from an outer electrically-conductive casing (ground to an internal combustion engine when in use) by an insulator sealed in the casing, separating the central electrode from the casing and having a taper-nose portion which is designed to be exposed to unburnt carbon in combustion gases of a combustion chamber, is modified to facilitate carbon removal from the taper-nose portion. Discrete isolated particles or isolated aggregates of particles of vanadium oxide are adhered over the exposed surface of the taper-nose portion to improve the self-cleaning ability of the spark plug without decreasing the degree of electrical insulation provided by the insulator. The particles of vanadium oxide are formed from a suspension which is applied to the surface of the taper-nose portion of the spark plug. The resulting coating is then dried in situ. Further heating results in having vanadium oxide particles, in insular form, firmly adhered to the surface of the taper-nose portion.

4 Claims, 7 Drawing Figures

Fig. 1
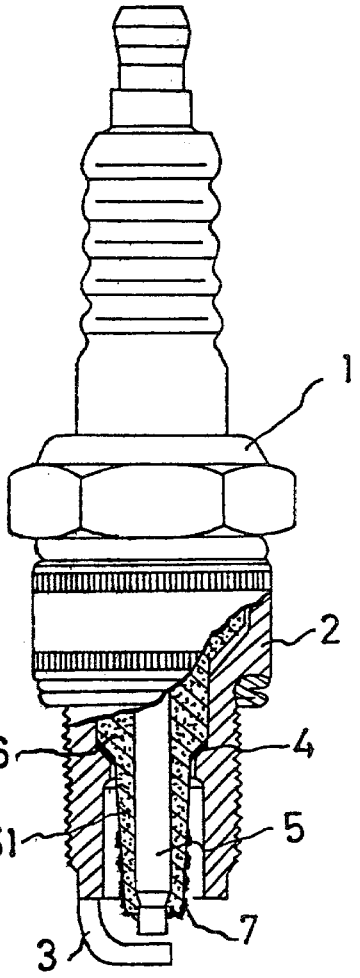
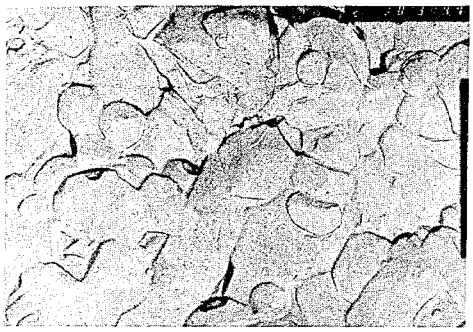
Fig. 4

SPARK PLUG HAVING VANADIUM OXIDE ISLANDS ON CENTRAL INSULATOR

BACKGROUND OF THE INVENTION

1. Field of the Invention

This invention relates to a spark plug, from which removal of unburnt carbon from the insulator surface is facilitated, and a process for producing same.

2. Prior Art

A gasoline motor vehicle, assembled in a factory, is usually moved a short distance from the factory to a motor pool or to some other place (for loading into a truck for shipment) by running a gasoline engine thereof prior to being dispatched to a user. The running mode for moving such a vehicle from the factory to any place is versatile. It is customary to run such a vehicle a short distance, e.g. in the order of 500 meters, and at a low speed, such as 30 to 40 km per hour, at each running. While running at a low speed for a short distance, a spark plug mounted in an engine tends to smolder, resulting in lowered insulation resistance of the insulator between the spark plug electrodes. This leads to misfiring and, hence, to defective running. Such a smoldering phenomenon is occasionally experienced in cold weather, such as in winter. The smoldering at a spark plug occurs not only with a new car but also with a used car, particularly in winter.

Such a smoldering phenomenon is caused by adhesion of unburnt carbon, such as carbon black, which accrues from the combustion of gasoline in an engine, to the surface of a taper-nose portion 61 of insulator 6 of a spark plug 1, which portion 61, as seen in FIG. 1, is exposed to combustion gases in an engine. FIG. 1 shows a housing 2, an electrode (ground) 3, a washer 4, and a central electrode 5.

To overcome the previously-described drawback, a ground was specially designed to use a creeping discharge to remove unburnt carbon from a spark plug. However, complications occurred in the construction of the periphery of the taper-nose portion 61 of insulator 6 and of the ground, and difficulties were encountered in the manufacture of such a spark plug.

SUMMARY OF THE INVENTION

An object of the present invention is to provide a spark plug so that unburnt carbon (adhering to the surface of a taper-nose portion of the electrical insulator between the two electrodes) is easily removed therefrom and which has improved self-cleaning ability.

Another object is to provide a spark plug which, in addition to improved self-cleaning ability, has excellent electrical insulation provided by the plug insulator.

A still further object is to provide a spark plug wherein particles of vanadium oxide, in insular form, stick to the peripheral surface of a taper-nose portion of the insulator.

A further object is to provide a process for producing a spark plug having the previously-described characteristics.

The foregoing and other objects are effected by the invention, as is apparent from the following description and claims.

To attain these objects, a spark plug (for an internal-combustion engine) having an insulator which electrically isolates a central electrode from a housing which surrounds it and provides a ground. The spark plug is characterized by vanadium oxide particles which, in insular form, adhere to the surface of a taper-nose portion of the insulator, which portion is exposed to combustion gases in an internal-combustion engine.

BRIEF DESCRIPTION OF THE DRAWINGS

FIG. 1 is a side view of a spark plug, partly shown in cross section;

FIG. 4 is an electron-photomicrograph of the surface of the taper-nose portion prior to formation thereon of particles of vanadium oxide.

DESCRIPTION OF THE PREFERRED EMBODIMENTS

Figure 2A:
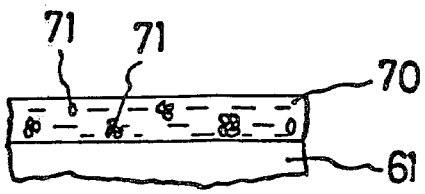
FIGS. 2*a* through 2*c* illustrate stages in the process for forming particles of vanadium oxide in insular form.

The expression, "insular form," means that isolated particles and/or agglomerates of particles of vanadium oxide are spaced from one another on the peripheral surface of the taper-nose portion. The particles of vanadium oxide do not provide a continuous line or coating on the peripheral surface of the taper-nose portion, but are in the form of islands thereon.

According to the present invention, the spark plug has improved self-cleaning ability due to the presence of islands of vanadium oxide on a taper-nose portion of the insulator. Vanadium oxide is provided in insular form or as islands on the peripheral surface of the taper-nose portion of a spark plug insulator so that required electrical insulation is not lowered.

As particles of vanadium oxide (in insular form) are separated from the taper-nose portion during spark plug service over a long period of time, it is most fortunate that such separated vanadium oxide particles are readily discharged to the exterior of the engine along with exhaust gases discharged therefrom, thus having no likelihood of damaging the engine. Furthermore, in a spark plug according to the present invention, since particles of vanadium oxide are merely islands on the taper-nose portion, the taper-nose portion of the insulator is free of an undesirable temperature rise during the running of the engine; there is no risk of pre-ignition during high-speed, high-load running.

In order to form particles of vanadium oxide in insular form on the peripheral surface of the taper-nose portion, all that is required is to apply a suspension, e.g. aqueous, of vanadium oxide to the taper-nose portion, followed by drying or by drying and baking. Thus, the formation of vanadium oxide in insular form is simple and easy.

The expression, "self-cleaning ability," means that, in the event that unburnt carbon adheres to the surface of the taper-nose portion as a result of running an engine at a low temperature for a short distance, the spark plug is heated by heat in the combustion chamber, the temperature of which is raised during a subsequent engine running cycle, thus resulting in the natural removal of carbon therefrom. The cleaning function is consequently achieved by the spark plug itself. In this connection, effecting self-cleaning at the lowest possible temperature is desired. For example, if a self-cleaning temperature of a spark plug having no specially-provided countermeasure for the self-cleaning is in the order of 550° C., it is desired that the self-cleaning temperature is lowered to lower than 500° C., more preferably lower than 450° C., by suitable countermeasures for the self-cleaning, in view of the improvement of a self-cleaning.

It is noteworthy that vanadium oxide, in insular form, sticks to the taper-nose surface of a spark plug insulator. By forming particles of vanadium oxide in insular form on the taper-nose portion, the self-cleaning ability of a spark plug is greatly improved. Since particles of vanadium oxide are in insular form and are thus spaced from one another of from aggregates thereof on the taper-nose surface, such particles of vanadium oxide do not impair the electric-insulation properties of the surface of the spark plug insulator. Were particles of vanadium oxide to form a continuum over the surface of the insulator, a breakdown in electric-insulating properties of the taper-nose surface of the insulator would be caused during spark plug service, reducing the effectiveness of the spark plug itself.

Figure 2B:
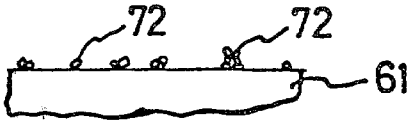
Figure 2C:
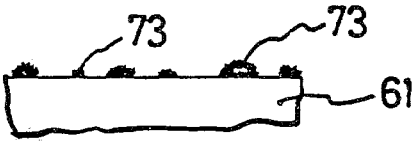

Particles of vanadium oxide may be of a primary particle consisting of a single particle of vanadium oxide or of a secondary agglomerated particle consisting of two or more particles agglomerated (see FIGS. 2*b* and 2*c*). As the degree of adhesion of vanadium oxide to the taper-nose insulator surface increases, the spark plug provides increased durability. Even when the sticking force is weak, the self-cleaning action is by no means impaired by the presence of vanadium oxide islands on the taper-nose portion.

In the present invention, a material for forming particles in insular form 7 is vanadium oxide. This is a generic term which includes all oxides of vanadium, e.g. vanadium pentoxide ($V_2O_5$) and vanadium trioxide ($V_2O_3$), individually or in any combination. However, vanadium pentoxide is preferred. The particles (in insular form) formed on the taper-nose portion of the insulator are also unlimited in their vanadium oxide constitution, which is, e.g., $V_2O_5$, $V_2O_3$ or a mixture thereof. Thus, whenever the formed particles are of an oxide of vanadium, the objects of the present invention are achieved irrespective of the type of vanadium oxide used.

In order to form particles of vanadium oxide in insular form on the taper-nose portion, powdered vanadium oxide is suspended in a liquid, such as water or alcohol, e.g. ethyl alcohol. The suspension is then applied to the taper-nose surface 61 of an insulator 6, followed by drying at a temperature in the range of from 40° to 100° C. The drying causes vanadium oxide to stick to the taper-nose portion of the insulator with a comparatively weak force. In this connection, baking at a temperature in a range of from 700° to 900° C. for five to thirty minutes, after drying, is recommended in order to ensure the adhesion of the vanadium oxide sticking to the taper-nose portion and to increase durability of the plug. The suspension is applied to the taper-nose portion, e.g., by dipping the taper-nose portion in the suspension of vanadium oxide, by coating the suspension on the taper-nose portion with a brush or by spraying the same on the taper-nose portion. The concentration of vanadium oxide in the suspension is from 0.01 to 6 percent by weight (the same throughout the specification), and a vanadium oxide concentration of from 0.5 to 5 percent by weight is preferred to obtain an extended duration of the self-cleaning function.

In forming particles of vanadium oxide in insular form on the taper-nose insulator surface, powdered vanadium oxide having a grain diameter of from 0.5 to 10$\mu$ is used. The particle density of vanadium oxide, in insular form, on the taper-nose portion is preferably in the range of from $3\times10^{-5}$ g to $3\times10^{-3}$ g per cm$^2$ of the taper-nose surface area. An average vanadium oxide particle thickness is preferably less than 10$\mu$ in view of the electrically insulating property of the insulator. However, the self-cleaning ability is reduced when particles of vanadium oxide are less than 0.1$\mu$ in thickness.

The formation of particles of vanadium oxide in insular form on the taper-nose portion is accomplished, e.g., by applying a liquid suspension of vanadium oxide to the taper-nose portion, drying and (optionally) heating. Particles of vanadium oxide, during the several steps, pass through the stages or states depicted by FIGS. 2*a*, 2*b* and 2*c*. As seen in these figures by application of the suspension to the taper-nose portion 61, a layer of suspension 70, wherein powdered vanadium oxide 71 in a suspended state, such as, of a primary particle or a secondary agglomerated particle, is formed on the taper-nose insulator surface 61 (FIG. 2*a*). By the succeeding drying step, the particles of vanadium oxide 72, in insular form, scatter and stick to the surface of the taper-nose portion 61 of the insulator (FIG. 2*b*). By the heating (for baking), following the drying, particles of vanadium oxide 72 are fused to cling closely and to adhere more securely to the surface of the insulator. The fused particles, after cooling, stiffen and remain in insular form as they stick firmly to the surface of the insulator, whereby vanadium oxide, in insular form 73, sticks on the surface of the taper-nose portion of the insulator (FIG. 2*c*).

Without further elaboration, one skilled in the art can, from the preceding description, appreciate and use the present invention to its fullest extent. The following specific embodiments are, therefore, merely illustrative and do not in any way limit the disclosure.

EXAMPLE 1

As a material for forming particles, in insular form, a suspension of powdered vanadium pentoxide ($V_2O_5$) is applied to the surface of a taper-nose portion 61 of a ceramic insulator 6 of a commercially-available spark plug. The spark plug insulator dried at about 60° C. for 30 seconds, and then heated (baked) in an electric furnace at 750° C. for 20 minutes, followed by cooling to obtain a spark plug having particles of vanadium oxide, in insular form, on the surface of the taper-nose portion 61. In this first embodiment, suspensions containing powdered vanadium pentoxide of 5, 1, 0.5, 0.1, and 0.01% by weight, respectively, are used, as shown in Table A, and the taper-nose portion 61 is dipped once in such suspension. The suspension is applied to an area of the taper-nose portion 61 covering from the lower tip to an upper portion thereof which is 10 mm distant from the lower tip thereof. Powdered vanadium pentoxide having an average grain diameter of 0.5 to 6$\mu$ is used, and ethyl alcohol is the suspension medium.

The particles and agglomerates of vanadium oxide form islands on the surface of the taper-nose portion 61 of insulator 6 and have average thicknesses, respectively, as shown in Table A.

The thus-obtained spark plug 1 is conventionally installed in an automobile engine. The engine is then run while the engine wall is being cooled in order to maintain nose portion 61 of the insulator 6 of the spark plug 1 at a temperature lower than 150° C. A large amount of unburnt carbon is thus made to adhere to the surface of the taper-nose portion 61. The spark plug 1 is then removed from the engine and placed in an electric furnace. The temperature of the electric furnace is raised by degrees to measure the temperature (carbon removal temperature) at which the unburnt carbon (adhering to the taper-nose portion) is removed from the spark plug. The aforesaid engine was run for 8 minutes at 1000 rpm/min. with a mixture charge of an air-fuel ratio of 5 or 6.

The results are given in Table A.

Table A also shows corresponding results for an untreated, commercially-available spark plug (No. $C_1$) having no vanadium oxide.

Table A confirms that, in case of spark plugs (Nos. 1 through 5) according to the present invention, a temperature at which the unburnt carbon is removed from the plugs is lower by from 100° to 120° C. than that required for a commercially-available spark plug (No. $C_1$) having no vanadium oxide thereon.

Figure 3B:
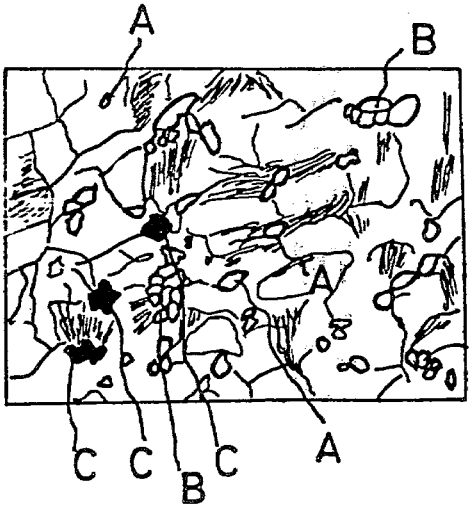
FIG. 3*b* is a sketch (copied by hand) of FIG. 3*a*.
Figure 3A:
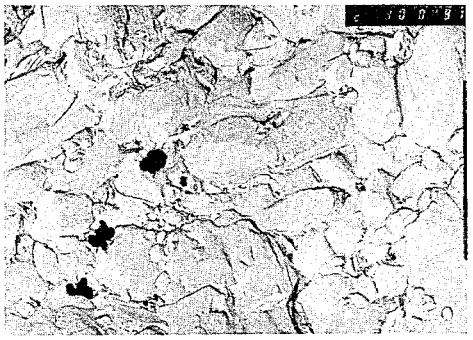
FIG. 3*a* is an electron-photomicrograph showing the distribution of particles (in insular form) of vanadium oxide on the surface of a taper-nose portion of a spark plug insulator.

In order to observe the distribution of vanadium oxide, in insular form, on spark plugs produced according to the present invention, the surface of the taper-nose portion of the insulator was electron-photomicrographed. FIG. 3*a* is an electron-photomicrograph (3000 magnifications) of spark plug No. 3 in Table A. In this photomicrograph, the minute granular form is a particle of vanadium oxide, in insular form, sticking to the surface of the taper-nose portion. For better presentation, a copy of the electron-photomicrograph was prepared by hand as FIG. 3*b*. In FIG. 3*b* the granular matters depicted by a thick line are the aforesaid particles of vanadium oxide in insular form, wherein a single particle (represented by reference symbol A) is the aforesaid primary particle, and groups of two or more particles (represented by reference symbol B) are the aforesaid secondary agglomerated particles. For reference, the black portions seen on the left of the photomicrograph of FIG. 3*a* (namely: the portions represented by reference symbol C in FIG. 3*b*) are portions from which particles of vanadium oxide have been separated at the production of a replica necessary for photomicrographing. For comparison purposes, FIG. 4 is an electron-photomicrograph, similar to that of FIG. 3*a*, on the surface of the taper-nose portion of the insulator of a commercially-available spark plug prior to being subjected to treatment according to the present invention.

TABLE A

| No. | Concentration of $V_2O_5$(wt %) | Mean Thickness of Particles in Insular Form (μ) | Carbon-Removal Temperature(°C.) |
|---|---|---|---|
| 1 | 5 | 8.0 | 430 |
| 2 | 1 | 1.6 | 430 |
| 3 | 0.5 | 0.8 | 430 |
| 4 | 0.1 | 0.16 | 450 |
| 5 | 0.01 | 0.016 | 450 |
| $C_1$ | None | — | 550 |

The aforesaid carbon removal temperature means a temperature at which unburnt carbon adherent to the taper nose portion of the insulator is completely removed from at least tip portion of the taper nose portion, so that the surface of the insulator surrounding a tip portion of the center electrode is maintained to be in an electric insulation state. This carbon removal temperature corresponds to a self-cleaning temperature and to improve the self-cleaning, lowering of this self-cleaning temperature is required.

EXAMPLE 2

By varying the concentration of vanadium oxide in a suspension, a variety of spark plugs is produced in a manner similar to that of Example 1, and the durability of the self-cleaning ability of each spark plug is measured.

More in detail, carbon is similarly made to adhere to respective spark plugs, which are the same as those in Example 1. The temperature at which such carbon is removed from the spark plug is measured, and then carbon is again made to adhere to the same spark plug according to the same procedure. The temperature at which this carbon is removed is then measured. Such procedures for adhesion and removal of carbon to and from the spark plug are repeated six times for each spark plug. Prior to the commencement of a succeeding procedure for adhesion of carbon, each spark plug is carefully examined to determine whether carbon adherent to the spark plug in the preceding cycle had been completely removed.

Carbon-removal-temperatures at respective cycles for each spark plug are shown in Table B. The measurement for the commercially-available untreated spark plug (No. $C_2$) is also given in Table B.

TABLE B

| No. | Concentration of $V_2O_5$ (wt %) | Carbon-Removal Temperature (°C.) First | Second | Third | Fourth | Fifth | Sixth |
|---|---|---|---|---|---|---|---|
| 6 | 5 | 430 | 430 | 430 | 440 | 440 | 440 |
| 7 | 1 | " | " | " | " | " | " |
| 8 | 0.5 | " | " | 440 | " | " | 450 |
| 9 | 0.1 | 450 | 450 | 450 | 460 | 460 | 460 |
| 10 | 0.01 | " | " | 460 | " | 480 | 480 |
| $C_2$ | None | 550 | 550 | 550 | 550 | 550 | 550 |

Table B confirms that the removal temperature for adhering matter, such as carbon, is maintained low even after six cycles of carbon-adhesion and removal for spark plugs (Nos. 6 through 10) of the present invention and, particularly in the case of the spark plugs (Nos. 6 through 9) treated with a suspension having more than 0.1% by weight of $V_2O_5$, the carbon removal temperatures are from 90° to 110° C. lower than that for the untreated spark plug (No. $C_2$), thus reflecting an extended duration of self-cleaning ability resulting from the presence of vanadium oxide islands on the taper-nose portion of the insulator.

EXAMPLE 3

By varying the $V_2O_5$ concentration, spark plugs (Nos. 11 and 12) are produced in a manner similar to that of Example 1, and carbon is made to adhere thereto in like manner. The adhered carbon is then removed at 450° C. The electrically-insulating property of the surface of the taper-nose portion of the insulator of each plug is determined by measuring the electric resistance between the central electrode and the ground of each spark plug.

For comparison purposes, a spark plug (No. $C_3$) is prepared by applying a paste (consisting of 70% by weight of vanadium pentoxide and 30% by weight of water) to the surface of the taper-nose portion of the insulator of the spark plug, drying the spark plug, and baking the same at 750° C. in an electric furnace for 20 minutes. Thus, there is obtained the spark plug (No. $C_3$)

having a layer of vanadium oxide formed uniformly over the entire surface of the taper-nose portion thereof. Then, carbon is made to adhere to the spark plug, is removed at 450° C., and the electrical insulation of the plug (No. $C_3$) is measured in the same manner as in Example 1.

The results are given in Table C, together with a concentration of $V_2O_5$ in the applied paste, a state of particles of vanadium oxide on the surface of the taper-nose portion of the insulator and the thickness of the layer.

TABLE C

| No. | Concentration of $V_2O_5$ (wt %) | State of Particles | Mean Thickness of Particles (μ) | Electric Resistance (Ω) |
|---|---|---|---|---|
| 11 | 0.1 | Scattered in insular form | 0.16 | Infinite |
| 12 | 1.0 | Scattered in insular form | 1.6 | " |
| $C_3$ | 70 | Substantially over the entire surface | 150 | 0.1 MΩ |

FIG. 3 shows that spark plugs Nos. 11 and 12 according to the present invention are unchangeably infinite in electric resistance even after service. In contrast thereto, the ignition plug (No. $C_3$), having a uniform layer of 150μ in thickness, does not have any particles in insular form on the surface of the taper-nose portion, the electric insulation of the taper-nose portion is impaired by only one cycle of adhesion of carbon and removal thereof by heating, and the spark plug No. $C_3$ nearly lost its inherent function. With spark plugs Nos. 11 and 12 in Table C, there is no breakdown in electric insulation even after 6 cycles of a carbon-adhering and removing operation.

No. $C_3$ spark plug turned light brown in an area of the taper-nose portion to which a large amount of $V_2O_5$ had been applied, and turned black in the aforesaid area when heated for removal of the adhering matter, such as carbon. This change to a black color is considered to relate to a change in electric insulation of the leg portion.

EXAMPLE 4

Spark plugs are produced by the same procedures as in Example 1, with the exception that the drying subsequent to the application of the suspension is effected at 100° C. for 30 seconds, and heating after drying is omitted. The duration of the self-cleaning ability of these spark plugs is measured in the same manner as in Example 2.

The results are given in Table D. The results of the test for the untreated plug No. $C_2$ are also given in this table.

TABLE D

| No. | Concentration of $V_2O_5$ (wt %) | Carbon-Removal Temperature (°C.) First | Second | Third | Fourth | Fifth | Sixth |
|---|---|---|---|---|---|---|---|
| 13 | 5 | 430 | 430 | 430 | 450 | 450 | 460 |
| 14 | 1 | " | " | " | " | " | 470 |
| 15 | 0.5 | " | " | 450 | " | 470 | 500 |
| 16 | 0.1 | 450 | 450 | 470 | 500 | 550 | 550 |
| 17 | 0.01 | " | " | 500 | 530 | " | " |
| $C_2$ | None | 550 | 550 | 550 | 550 | 550 | 550 |

As is obvious from Table D, even the spark plugs which have not been heated after the drying present improved self-cleaning ability. A comparison of Table D with Table B shows that spark plugs subjected to heating after drying in Table B have a more-extended duration of self-cleaning ability, as compared with those in Table D, which are produced by a process excluding heating subsequent to drying or by a process including heating after drying are, respectively, mounted in an engine. The engine is run a short distance at a low speed, as in actual running. These spark plugs perform their function without causing smoldering.

The invention and its advantages are readily understood from the foregoing description. Various changes may be made in the process and in the products without departing from the spirit and scope of the invention or sacrificing its material advantages. The process, products and new use, hereinbefore described, are exemplary of preferred embodiments and are not intended to limit the claims which follow.

What is claimed is:

1. In an internal-combustion-engine spark plug having an insulator with a taper-nose portion which is exposed to combustion gases when the spark plug functions in a running internal-combustion engine and wherein the insulator provides electrical insulation between an axially-disposed electrode and a surrounding casing, the improvement wherein the taper-nosed portion has an outer surface which is characterized by the presence thereon of vanadium oxide islands having an average thickness of from 0.1 to 10 microns.

2. A spark plug according to claim 1 wherein the vanadium oxide comprises at least one member selected from the group consisting of $V_2O_5$ and $V_2O_3$.

3. A spark plug according to claim 2 wherein the vanadium oxide is strongly adhered to the taper-nose surface.

4. A spark plug according to claim 1 wherein the outer surface of the taper-nose portion has adhered thereto from $3\times10^{-5}$ to $3\times10^{-3}$ grams of vanadium oxide, in insular form, per square centimeter of surface area.

* * * * *